US007230213B2

(12) United States Patent
Naylor

(10) Patent No.: US 7,230,213 B2
(45) Date of Patent: Jun. 12, 2007

(54) MODULAR HEATED COVER

(76) Inventor: David Naylor, 745 W. Alan Point Cir., Draper, UT (US) 84020

( * ) Notice: Subject to any disclaimer, the term of this patent is extended or adjusted under 35 U.S.C. 154(b) by 0 days.

(21) Appl. No.: 11/218,156

(22) Filed: Sep. 1, 2005

(65) Prior Publication Data

US 2006/0191902 A1 Aug. 31, 2006

Related U.S. Application Data

(60) Provisional application No. 60/654,702, filed on Feb. 17, 2005, provisional application No. 60/656,060, filed on Feb. 23, 2005, provisional application No. 60/688,146, filed on Jun. 6, 2005.

(51) Int. Cl.
*H05B 3/34* (2006.01)

(52) U.S. Cl. ..... 219/528; 219/213; 219/539

(58) Field of Classification Search ..... 219/528, 219/529, 212, 213, 217, 545, 548, 549
See application file for complete search history.

(56) References Cited

U.S. PATENT DOCUMENTS 3,417,229 A * 12/1968 Shomphe et al. ..... 219/528
3,510,547 A 5/1970 Eisler ..... 264/33
3,649,725 A 3/1972 Olson ..... 264/40
3,659,077 A 4/1972 Olson ..... 219/213
3,729,614 A 4/1973 Martinet ..... 219/345
3,812,320 A 5/1974 Borgren ..... 219/213
3,868,825 A 3/1975 Boyce ..... 61/36
3,897,928 A 8/1975 Eisler ..... 249/78
4,060,710 A * 11/1977 Reuter et al. ..... 219/548
4,091,266 A * 5/1978 Ito et al. ..... 219/504
4,238,105 A 12/1980 West ..... 249/78
4,316,080 A * 2/1982 Wroblewski ..... 219/505

(Continued)

FOREIGN PATENT DOCUMENTS

JP 04350257 12/1992

(Continued)

OTHER PUBLICATIONS

"Thawzall Heater" http://www.themachinecompany.com/faq.htm.

(Continued)

*Primary Examiner*—Robin Evans
*Assistant Examiner*—Vinod Patel
(74) *Attorney, Agent, or Firm*—Kunzler & McKenzie

(57) ABSTRACT

The modular heated cover is disclosed with a first pliable outer layer and a second pliable outer layer, wherein the outer layers provide durable protection in an outdoor environment, an electrical heating element between the first and the second outer layers, the electrical heating element configured to convert electrical energy to heat energy, and a thermal insulation layer positioned above the active electrical heating element. Beneficially, such a device provides radiant heat, weather isolation, temperature insulation, and solar heat absorption efficiently and cost effectively. The modular heated cover quickly and efficiently removes ice, snow, and frost from surfaces, and penetrates soil and other material to thaw the material to a suitable depth. A plurality of modular heated covers can be connected on a single 120 Volt circuit protected by a 20 Amp breaker.

23 Claims, 9 Drawing Sheets

U.S. PATENT DOCUMENTS

| | | | | |
|---|---|---|---|---|
| 4,423,694 | A | 1/1984 | Senneville | 112/405 |
| 4,457,491 | A | 7/1984 | Dudman | 251/317 |
| 4,607,154 | A * | 8/1986 | Mills | 219/505 |
| 4,899,031 | A | 2/1990 | Dyer | 219/213 |
| 4,967,057 | A * | 10/1990 | Bayless et al. | 219/213 |
| 5,371,340 | A * | 12/1994 | Stanfield | 219/217 |
| 5,590,478 | A | 1/1997 | Furness | 34/437 |
| 5,614,292 | A * | 3/1997 | Saylor | 428/209 |
| 5,780,367 | A | 7/1998 | Handwerker | 442/235 |
| 5,824,996 | A | 10/1998 | Kochman et al. | 219/529 |
| 6,057,530 | A * | 5/2000 | Gurevich | 219/529 |
| 6,184,496 | B1 * | 2/2001 | Pearce | 219/213 |
| 6,189,487 | B1 * | 2/2001 | Owen et al. | 119/28.5 |
| 6,211,493 | B1 * | 4/2001 | Bouman | 219/213 |
| 6,279,856 | B1 | 8/2001 | Rutherford et al. | 244/134 |
| 6,294,768 | B1 | 9/2001 | Liebich | 219/528 |
| 6,330,986 | B1 | 12/2001 | Rutherford et al. | 244/134 |
| 6,330,988 | B1 | 12/2001 | Liu et al. | 244/134 |
| 6,392,209 | B1 * | 5/2002 | Oppitz | 219/549 |
| 6,426,488 | B2 * | 7/2002 | Schielke | 219/505 |
| 6,483,087 | B2 * | 11/2002 | Gardner et al. | 219/545 |
| 6,657,170 | B2 * | 12/2003 | Clothier | 219/622 |
| 6,664,520 | B2 * | 12/2003 | Clothier | 219/634 |
| 6,667,100 | B2 * | 12/2003 | Rutherford et al. | 428/408 |
| 6,673,289 | B2 | 1/2004 | Reynolds, III et al. | 264/115 |
| 6,841,250 | B2 | 1/2005 | Tzeng | 428/408 |
| 6,855,915 | B2 * | 2/2005 | Gehring | 219/213 |
| 6,886,233 | B2 | 5/2005 | Rutherford et al. | 29/426.4 |
| 6,943,320 | B1 * | 9/2005 | Bavett | 219/213 |
| 7,049,559 | B2 * | 5/2006 | Ishii et al. | 219/549 |

FOREIGN PATENT DOCUMENTS

| | | |
|---|---|---|
| JP | 06129095 | 5/1994 |
| JP | 2001123667 | 5/2001 |

OTHER PUBLICATIONS

"Q Foil Performance" http://www.rotabolt.com/html/qfoil_1.html.
"Q Foil Technology" http://www.rotabolt.com/html/qfoil./html.
"Q Foil Product Features" http://www.rotabolt.com/html/qfoil_2.html.
"Thawzall Product Selection" http://www.themachinecompany.com/products.htm.
"Ground Heaters S3000" http://www.groundheaters.com/s3000.htm.
"How It Works" http://www.groundheaters.com/how_it_works.htm.
"GrafTech" http://www.graphtech.com.
"FP Parallel Constant Watt Heating Cable" Thermon Manufactuding Co.
"SCS Concrete Curing Blankets" http://www.scsincorporated.com/Curingblankets.htm.
"Mauritzon Concrete Curing Blankets" http://www.mauritzononline.com/concretecure.html.
"Concrete-Curing-Blankets.Com" http://concrete-curing-blankets.com/.
"Janell Concrete Curing Methods" http://www.janell.com/engineering_data.html.
"GrafTech Material Safety Data Sheet" May 17, 2005.
Concrete Curing Technology, Inc. "Instructions for Use of Pad".

* cited by examiner

MODULAR HEATED COVER

CROSS-REFERENCES TO RELATED APPLICATIONS

This application claims the benefit of U.S. Provisional Patent Application No. 60/654,702 entitled "A MODULAR ACTIVELY HEATED THERMAL COVER" and filed on Feb. 17, 2005 for David Naylor and U.S. Provisional Patent Application No. 60/656,060 entitled "A MODULAR ACTIVELY HEATED THERMAL COVER" and filed on Feb. 23, 2005 for David Naylor, and Provisional Patent Application No. 60/688,146 entitled "LAMINATE HEATING APPARATUS" and filed on Jun. 6, 2005 for David Naylor, which are incorporated herein by reference.

FIELD OF THE INVENTION

This invention relates to thermal covers and more particularly relates to modular heated covers configured to couple together.

DESCRIPTION OF THE RELATED ART

Ice, snow and, frost create problems in many areas of construction. For example, when concrete is poured the ground must be thawed and free of snow and frost. In agriculture, planters often plant seeds, bulbs, and the like before the last freeze of the year. In such examples, it is necessary to keep the concrete, soil, and other surfaces free of ice, snow, and frost. In addition, curing of concrete requires that the ground, ambient air, and newly poured concrete maintain a temperature between about 50 degrees and about 90 degrees. In industrial applications, outdoor pipes and conduits often require heating or insulation to avoid damage caused by freezing. In residential applications, it is beneficial to keep driveways and walkways clear of snow and ice.

Standard methods for removing and preventing ice, snow, and frost include blowing hot air or water on the surfaces to be thawed, running electric heat trace along surfaces, and/or laying tubing or hoses carrying heated glycol or other fluids along a surface. Unfortunately, such methods are often expensive, time consuming, inefficient, and otherwise problematic.

In construction, ice buildup is particularly problematic. For example, ice and snow may limit the ability to pour concrete, lay roofing material, and the like. In these outdoor construction situations, time and money are frequently lost to delays caused by snow and ice. If delay is unacceptable, the cost to work around the situation may be unreasonable. For example, if concrete is to be poured, the ground must be thawed to a reasonable depth to allow the concrete to adhere to the ground and cure properly. Typically, in order to pour concrete in freezing conditions, earth must be removed to a predetermined depth and replaced with gravel. This process is costly in material and labor.

In addition, it is important to properly cure the concrete for strength once it has been poured. Typically the concrete must cure for about seven days at a temperature within the range of 50 degrees Fahrenheit to 90 degrees Fahrenheit, with 70 degrees Fahrenheit as the optimum temperature. If concrete cures in temperatures below 50 degrees Fahrenheit, the strength and durability of the concrete is greatly reduced. In an outdoor environment where freezing temperatures exist or may exist, it is difficult to maintain adequate curing temperatures.

In roofing and other outdoor construction trades, it may be similarly important to keep work surfaces free of snow, ice, and frost. Additionally, it may be important to maintain specific temperatures for setting, curing, laying, and pouring various construction products including tile, masonry, or the like.

Although the need for a solution to these problems is particularly great in outdoor construction trades, a solution may be similarly beneficial in various residential, industrial, manufacturing, maintenance, and service fields. For example, a residence or place of business with an outdoor canopy, car port, or the like may require such a solution to keep the canopy free of snow and ice to prevent damage from the weight of accumulated precipitation or frost. Conventional solutions for keeping driveways, overhangs, and the like clear of snow, typically require permanent fixtures that are both costly to install and operate, or small portable devices that do not cover sufficient surface area.

While some solutions are available for construction industries to thaw ground, keep ground thawed, and cure concrete, these solutions are large, expensive to operate and own, time consuming to setup and take down, and complicated. Conventional solutions employ heated air, oil, or fluid delivered to a thawing site by hosing. Typically, the hosing is then covered by a cover such as a tarp or enclosure. Laying and arranging the hosing and cover can be time consuming. Furthermore, heating and circulating the fluid requires significant energy in the form of heaters, pumps, and/or generators.

Currently, few conventional solutions exist that use electricity to produce and conduct heat. Traditionally, this was due to limited circuit designs. Traditional solutions were unable to produce sufficient heat over a sufficient surface area to be practical. The traditional solutions that did exist required special electrical circuits with higher voltages and protected by higher rated breakers. These special electrical circuits are often unavailable at a construction site. Thus using conventional standard circuits, conventional solutions are unable to produce sufficient heat over a sufficiently large surface area to be practical. Typically, 143 BTUs are required to melt a pound of ice. Conventional electrically powered solutions are incapable of providing 143 BTUs over a sufficiently large enough area for practical use in the construction industry. Consequently, the construction industry has turned to bulky, expensive, time consuming heated fluid solutions.

What is needed is a modular heated cover that operates using electricity from standard job site power supplies, is cost effective, portable, reusable, and modular to provide heated coverage for variable size surfaces efficiently and cost effectively. For example, the modular heated cover may comprise a pliable material that can be rolled or folded and transported easily. Furthermore, the modular heated cover would be configured such that two or more modular heated covers can easily be joined to accommodate various surface sizes. Beneficially, such a device would provide directed radiant heat, modularity, weather isolation, temperature insulation, and solar heat absorption. The modular heated cover would maintain a suitable temperature for exposed concrete to cure properly and quickly and efficiently remove ice, snow, and frost from surfaces, as well as penetrate soil and other material to thaw the material to a suitable depth for concrete pours and other construction projects.

SUMMARY OF THE INVENTION

The present invention has been developed in response to the present state of the art, and in particular, in response to the problems and needs in the art that have not yet been fully solved by currently available ground covers. Accordingly, the present invention has been developed to provide a modular heated cover and associated system that overcomes many or all of the above-discussed shortcomings in the art.

A modular heated cover is presented with a first pliable outer layer and a second pliable outer layer, wherein the outer layers provide durable protection in an outdoor environment, and an electrical heating element between the first and the second outer layers. The electrical heating element is configured to convert electrical energy to heat energy. The electrical heating element is disposed between the first and the second outer layers such that the electrical heating element evenly distributes heat over a surface area defined substantially by the first and the second outer layers. The modular heated cover includes a thermal insulation layer positioned above the active electrical heating element and between the first and second outer layers. The thermal insulation layer is configured such that heat from the electrical heating element is conducted away from the thermal insulation layer. In a further embodiment, the thermal cover may comprise an electric power coupling connected to the electrical heating element and configured to optionally convey electrical energy from a first modular heated cover to a second modular heated cover.

Additionally, the first outer layer may be positioned on the top of the thermal cover and colored to absorb heat energy, and the second outer layer may be positioned on the bottom of the thermal cover and colored to retain heat energy beneath the thermal cover. In one embodiment, the thermal insulation layer is integrated with one of the first outer layer and the second outer layer. Additionally, the outer layers may be sealed together to form a water resistant envelope around the thermal insulation layer and electrical heating element.

In one further embodiment, the electrical heating element may comprise a resistive element for converting electric current to heat energy and a substantially planar heat spreading element for distributing the heat energy generated by the resistive element. In one embodiment, the electrical heating element generates substantially consistent levels of thermal energy across the surface area of the thermal cover. Additionally, the thermal cover may comprise at least one receiving power coupling and at least one conveying power coupling. In one embodiment, the conveying power coupling of a first modular heated cover can be optionally or removably coupled to the receiving power coupling of a second modular heated cover such that the first modular heated cover and second modular heated cover draw electricity from a single circuit providing up to about 120 Volts. The single circuit is preferably protected by up to about a 20 Amp breaker. In certain embodiments, the electrical heating element is configured such that the electrical heating element has a negative temperature coefficient of resistance.

The negative temperature coefficient of resistance provides that minimal in rush current is drawn in response to connecting the modular heated cover to a power source or to a second modular heated cover with the first modular heated cover coupled to a power source. In one embodiment, the material of the electrical heating element comprises substantially carbon structured to form graphite. Alternatively, the material of the electrical heating element may comprise germanium, silicon, and the like.

In certain embodiments, the electrical heating element is pliable and comprises a resistive element for converting electric current to heat energy. The resistive element may be disposed between a protective layer and a substrate. The resistive element may be disposed on the substrate according to a pattern configured to evenly distribute heat from the resistive element throughout the substrate. The surface area of the pliable electrical heating element may be between about one square foot and about 253 square feet In an additional embodiment, the thermal cover further comprises an air isolation flap configured to retain heated air beneath the thermal cover. Preferably, the heated air maintains a temperature between about 50 degrees and about 90 degrees. Additionally, the thermal cover may comprise fasteners disposed about the perimeter of the heated thermal cover for securing the thermal cover in a predetermined location. In one embodiment, the layers of the thermal cover are pliable.

Alternative embodiments of the modular heated cover may include a top layer and a bottom layer, wherein the top and bottom layers provide durable protection in an outdoor environment, a resistive element between the top and the bottom layers for converting electric current to heat energy, a planar heat spreading element in contact with the resistive element for distributing the heat energy generated by the resistive element, an air isolation flap configured to prevent heat loss to air circulation, an electrical power connection for obtaining electrical energy from a power source, and an electric power coupling for conveying electrical energy from a first modular heated cover to a second modular heated cover.

In one embodiment, the top layer is further configured to resist sun rot. Additionally, the top and bottom layers comprise rugged material configured to withstand outdoor use. The thermal cover may be configured to generate and evenly distribute between about 2 Watts per square foot and about 4 Watts per square foot with the power source providing about 6 to 10 Amps and about 120 Volts. Additionally, the thermal cover may be configured to maintain temperatures suitable for curing concrete between 50 degrees Fahrenheit and 90 degrees Fahrenheit in freezing ambient conditions.

In certain embodiments, the thermal cover is substantially rectangular in shape, and the heat spreading element substantially covers the area of the thermal cover. In a further embodiment, the resistive element and the planar heat spreading element are integrated. Additionally, the heat spreading element may be thermally isotropic in the horizontal plane.

The thermal cover may additionally comprise a Ground Fault interrupter (GFI) device. In certain embodiments, the thermal cover may further include a crease configured to facilitate folding of the thermal cover.

A system of the present invention is also presented for heating a surface. The system may include a power source configured to supply a predetermined electrical current. Preferably, the power source is a conventional 120 Volt circuit protected by up to about a 20 Amp breaker. Additionally, the system may include one or more modular actively heated thermal covers similar to the modular heated covers described above. In certain embodiments, the system also includes an electrical power plug for obtaining electrical energy from the power source, and an electrical power socket for conveying electrical energy from a first modular actively heated thermal cover to a second modular actively heated thermal cover.

The system may further include multiple power couplings positioned at distributed points on the thermal cover for convenience in coupling multiple thermal covers. Additionally, the system may include one or more power extension cords configured to convey sufficient electrical current to power the electrical heating element of the modular actively heated thermal covers. In a further embodiment, the thermal cover may further comprise one or more 120 V power couplings, one or more 240 V power couplings, wherein a portion of the electrical heating element is isolated from the power source when the 120 V power coupling is connected.

In certain embodiments, the system may include a temperature controller coupled to the electrical heating element and configured to sense a temperature value and control the power supplied to the electrical heating element in response to the temperature value. Additionally, the thermal cover may further comprise an air isolation flap configured to overlap with a second modular actively heated thermal cover.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention. These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of materials, layers, connectors, conductors, insulators, and the like, to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
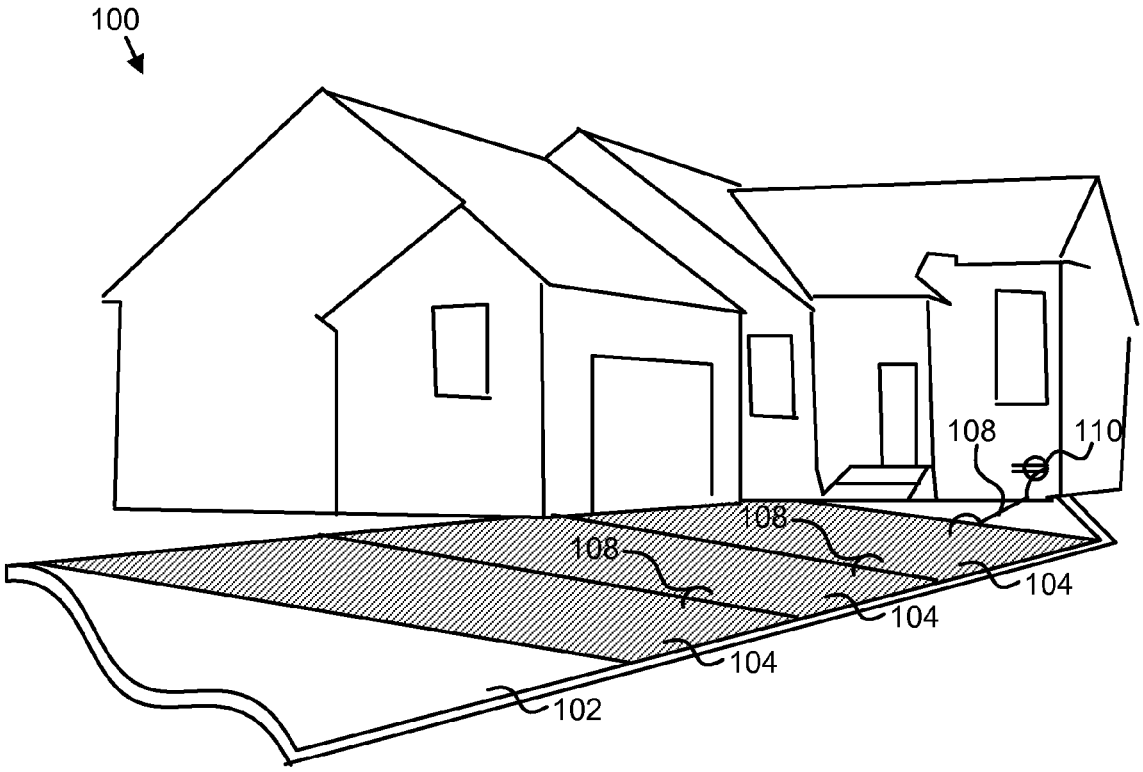
FIG. 1 is a schematic diagram illustrating one embodiment of a system for implementing a modular heated cover.

FIG. 1 illustrates one embodiment of a system 100 for implementing a modular heated cover. In one embodiment, the system 100 includes a surface 102 to be heated, one or more modular heated covers 104, one or more electrical coupling connections 106, a power extension cord 108, and an electrical power source 110.

In various embodiments, the surface to be heated 102 may be planer, curved, or of various other geometric forms. Additionally, the surface to be heated 102 may be vertically oriented, horizontally oriented, or oriented at an angle. In one embodiment, the surface to be heated 102 is concrete. For example, the surface 102 may include a planar concrete pad. Alternatively, the surface may be a cylindrical concrete pillar poured in a vertically oriented cylindrical concrete form. In such embodiments, the thermal cover 104 may melt frost, ice and snow on the concrete and prevent formation of ice, frost and snow on the surface of the concrete and thermal cover 104.

In another alternative embodiment, the surface 102 may be ground soil of various compositions. In certain circumstances, it may be necessary to heat a ground surface 102 to thaw frozen soil and melt frost and snow, or prevent freezing of soil and formation of frost and snow on the surface of the soil and thermal cover 104. It may be necessary to thaw frozen soil to prepare for pouring new concrete. One of ordinary skill in the art of concrete will recognize the depth of thaw required for pouring concrete and the temperatures required for curing concrete. Alternatively, the surface 102 may comprise poured concrete that has been finished and is beginning the curing process.

In one embodiment, one or more modular heated covers 104 are placed on the surface 102 to thaw or prevent freezing of the surface 102. A plurality of thermal covers 104 may be connected by electrical coupling connections 106 to provide heat to a larger area of the surface 102. In one embodiment, the modular heated covers 104 may include a physical connecting means, an electrical connector, one or more insulation layers, and an active electrical heating element. The electrical heating elements of the thermal covers 104 may be connected in a series configuration. Alternatively, the electrical heating elements of the thermal covers 104 may be connected in a parallel configuration. Detailed embodiments of modular heated covers 104 are discussed further with relation to FIG. 2 through FIG. 4.

In certain embodiments, the electrical power source 110 may be a power outlet connected to a 120V or 240 V AC power line. Alternatively, the power source 110 may be an electricity generator. In certain embodiments, the 120V power line may supply a range of current between about 15 A and about 50 A of electrical current to the thermal cover 104. Alternative embodiments of the power source 110 may include a 240V AC power line. The 240V power line may supply a range of current between about 30 A and about 70 A of current to the thermal cover 104. Various other embodiments may include supply of three phase power, Direct Current (DC) power, 110 V or 220 V power, or other power supply configurations based on available power, geographic location, and the like.

In one embodiment, a power extension cord 108 may be used to create an electrical connection between a modular heated cover 104, and an electrical power source 110. In one embodiment, the extended electrical coupler 108 is a standard extension cord. Alternatively, the extended electrical coupler 108 may include a heavy duty conductor such as 4 gauge copper and the required electrical connector configuration to connect to high power outlets. Power extension cords 108 may be used to connect the power source 110 to the thermal covers 104, or to connect one thermal cover 104 to another thermal cover 104. In such embodiments, the power extension cords 108 are configured to conduct sufficient electrical current to power the electrical heating element of the modular heated covers 104. One of ordinary skill in the art of power engineering will understand the conductor gauge requirements based on the electric current required to power the thermal cover 104.

Figure 2:
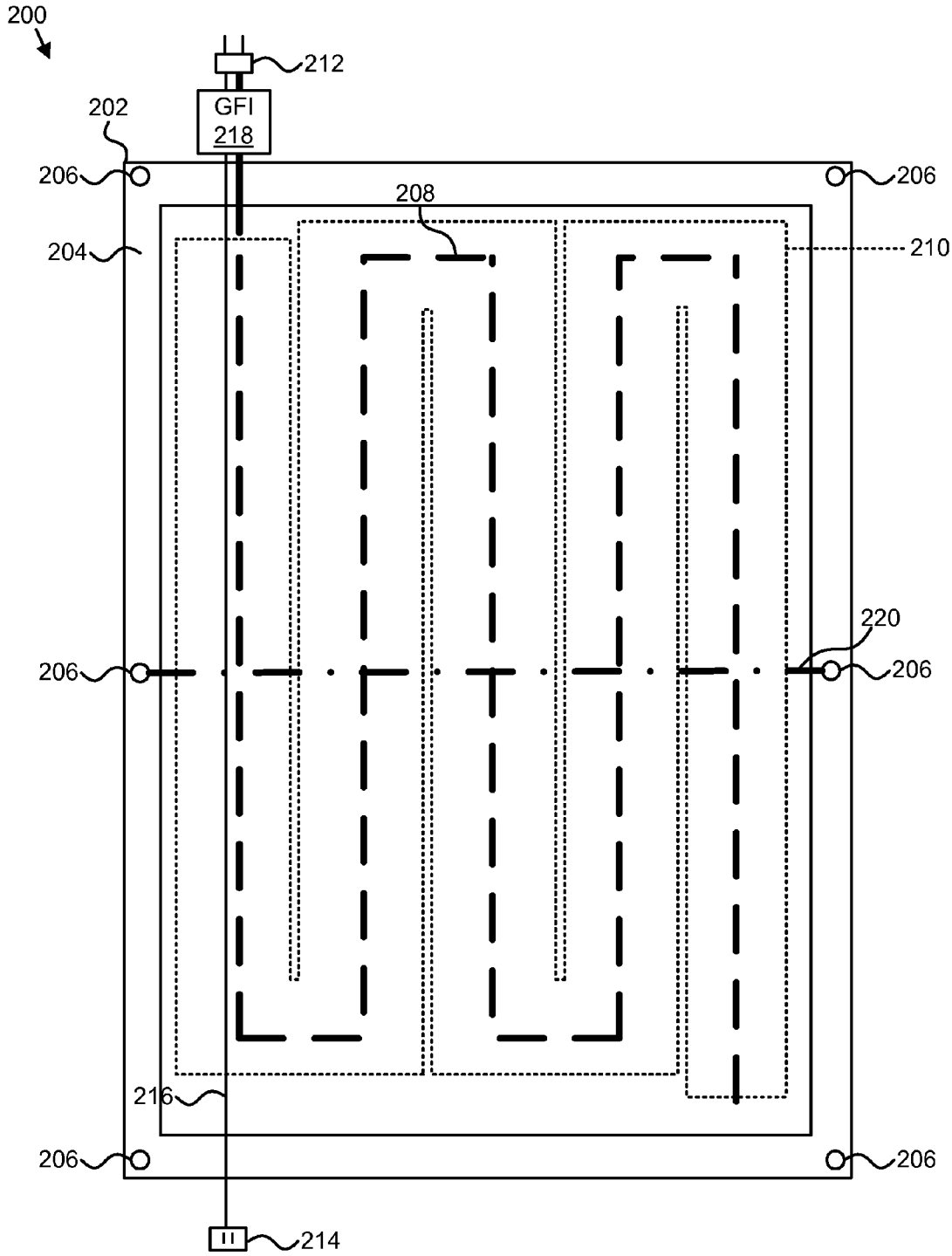
FIG. 2 is a schematic diagram illustrating one embodiment of a modular heated cover.

FIG. 2 illustrates one embodiment of a modular heated cover 200. In one embodiment, the cover 200 includes a multilayered cover 202. The multilayered cover 202 may include a flap 204. Additionally, the cover 200 may be coupled to an electrical heating element. In one embodiment, the electrical heating element comprises a resistive element 208 and a heat spreading element 210. The cover 200 may additionally include one or more fasteners 206, one or more electric power connections 212, one or more electric power couplings 214, and an electrical connection 216 between the connections 212 and the couplings 214. In certain embodiments the thermal cover 200 may additionally include a GFI device 218 and one or more creases 220.

The multilayered cover 202 may comprise a textile fabric. The textile fabric may include natural or synthetic products. For example, the multilayered cover 202 may comprise burlap, canvas, or cotton. In another example, the multilayered cover 202 may comprise nylon, vinyl, or other synthetic textile material. For example, the multilayered cover 202 may comprise a thin sheet of plastic, metal foil, polystyrene, or the like. Further embodiments of the multilayered cover 202 are discussed below with regard to FIG. 3.

In one embodiment, the flap 204 may overlap another thermal cover 200. The flap 204 may provide isolation of air trapped beneath the thermal cover 200. Isolation of the air trapped beneath the thermal cover 200 prevents heat loss due to air circulation. Additionally, the flap 204 may include one or more fasteners 206 for hanging, securing, or connecting the thermal cover 200. In one embodiment, the fasteners 206 may be attached to the corners of the cover 200. Additionally, fasteners 206 may be distributed about the perimeter of the cover 200. In one embodiment, the fastener 206 is Velcro™. For example, the flap may include a hook fabric on one side and a loop fabric on the other side. In another alternative embodiment, the fastener 206 may include snaps, zippers, adhesives, and the like.

In one embodiment, the electrical heating element comprises an electro-thermal coupling material or resistive element 208. For example, the resistive element 208 may be a copper conductor. The copper conductor may convert electrical energy to heat energy, and transfer the heat energy to the surrounding environment. Alternatively, the resistive element 208 may comprise another conductor capable of converting electrical energy to heat energy. One skilled in the art of electro-thermal energy conversion will recognize additional material suitable for forming the resistive element 208. Additionally, the resistive element 208 may include one or more layers for electrical insulation, temperature regulation, and ruggedization. In one embodiment, the resistive element 208 may include two conductors connected at one end to create a closed circuit.

Additionally, the electrical heating element may comprise a heat spreading element 210. In general terms, the heat spreading element 210 is a layer or material capable of drawing heat from the resistive element 208 and distributing the heat energy away from the resistive element 208. Specifically, the heat spreading element 210 may comprise a metallic foil, graphite, a composite material, or other substantially planar material. Preferably, the heat spreading element 210 comprises a material that is thermally isotropic in one plane. The thermally isotropic material may distribute the heat energy more evenly and more efficiently. One such material suitable for forming the heat spreading layer 210 is GRAFOIL® available from Graftech Inc. located in Lakewood, Ohio. Preferably, the heat spreading element 210 is a planar thermal conductor. In certain embodiments, the heat spreading layer 210 is formed in strips along the length of the resistive element 208. In alternative embodiments, the heat spreading element 210 may comprise a contiguous layer. In certain embodiments, the heat spreading layer 210 may cover substantially the full surface area covered by the thermal cover 200 for even heat distribution across the full area of the thermal cover 200.

In certain embodiments, the resistive element 208 is in direct contact with the heat spreading element 210 to ensure efficient thermo-coupling. Alternatively, the heat spreading element 210 and the resistive element 208 are integrally formed. For example, the heat spreading element 210 may be formed or molded around the resistive element 208. Alternatively, the resistive element 208 and the heat spreading element 210 may be adhesively coupled.

In one embodiment, the thermal cover 200 includes means, such as electrical coupling connections 106, for electric power transfer from one thermal cover 200 to another in a modular chain. For example, the thermal cover 200 may include an electric connection 212 and an electric coupling 214. In one embodiment, the electric connection 212 and the electric coupling 214 may include an electric plug 212 and an electric socket 214, and are configured according to standard requirements according to the power level to be transferred. For example, the electric plug 212 and the electric socket 214 may be standard two prong connectors for low power applications. Alternatively, the plug 212 and socket 214 may be a three prong grounded configuration, or a specialized prong configuration for higher power transfer.

In one embodiment, the electrical connection 216 is an insulated wire conductor for transferring power to the next thermal cover 200 in a modular chain. The electrical connection 216 may be connected to the electric plug 212 and the electric socket 214 for a power transfer interface. In one embodiment, the electrical connection 216 is configured to create a parallel chain of active electrical heating elements 210. Alternatively, the electrical connection 216 is configured to create a series configuration of active electrical heating elements 210. In an alternative embodiment, the resistive element 212 may additionally provide the electrical connection 216 without requiring a separate conductor. In certain embodiments, the electrical connection 216 may be configured to provide electrical power to a plurality of electrical power couplings 214 positioned at distributed points on the thermal cover 200 for convenience in coupling multiple modular thermal covers 200. For example, a second thermal cover 200 may be connected to a first thermal cover 200 by corresponding power couplings 214 to facilitate positioning of the thermal covers end to end, side by side, in a staggered configuration, or the like.

Additionally, the thermal cover 200 may include a Ground Fault Interrupter (GFI) or Ground Fault Circuit Interrupter (GFCI) safety device 218. The GFI device 218 may be coupled to the power connection 212. In certain embodiments, the GFI device 218 may be connected to the resistive element 208 and interrupt the circuit created by the resistive element 208. The GFI device 218 may be provided to protect the thermal cover 200 from damage from spikes in electric current delivered by the power source 110.

In certain additional embodiments, the thermal cover 200 may include one or more creases 220 to facilitate folding the thermal cover 200. The creases 220 may be oriented across the width or length of the thermal cover 200. In one embodiment, the crease 220 is formed by heat welding a first outer layer to a second outer layer. Preferably, the thermal cover 200 comprises pliable material, however the creases 220 may facilitate folding a plurality of layers of the thermal cover 200.

In one embodiment, the thermal cover 200 may be twelve feet by twenty-five feet in dimension. In another embodiment, the thermal cover 200 may be six feet by twenty-five feet. In a more preferred embodiment, the thermal cover 200 is eleven feet by twenty three feet. Alternatively, the thermal cover 200 may be two to four feet by fifty feet to provide thermal protection to the top of concrete forms. Additional alternative dimensional embodiments may exist. Consequently, the thermal cover 200 in different size configurations covers between about one square foot up to about two-hundred and fifty-three square feet.

Beneficially, a two-hundred and fifty-three square foot area is covered and kept at optimal concrete curing temperatures or at optimal heating temperatures for thawing froze or cold soil. Advantageously, the high square footage can be heated using a single thermal cover 200 connected to a single 120 volt circuit. Preferably, the 120 volt circuit is protected by up to about a 20 Amp breaker. In addition, with the first thermal cover 200 connected to the power source 110 a second thermal cover 200 can be safely connected to the first thermal cover 200 without tripping the breaker.

Consequently, the present invention allows up to two or more thermal covers 200 to be modularly connected such that about five hundred and six square feet are covered and heated using the present invention. Advantageously, the five hundred and six square feet are heated using a single 120 Volt circuit protected by up to a 20 Amp breaker. Tests of certain embodiments of the present invention have been conducted in which two thermal covers 200 were modularly connected to cover about five hundred and six square feet. Those of skill in the art will recognize that more than two thermal covers may be connected on a single 120 Volt circuit with up to a 20 Amp breaker if the watts used per foot is lowered.

Figure 3:
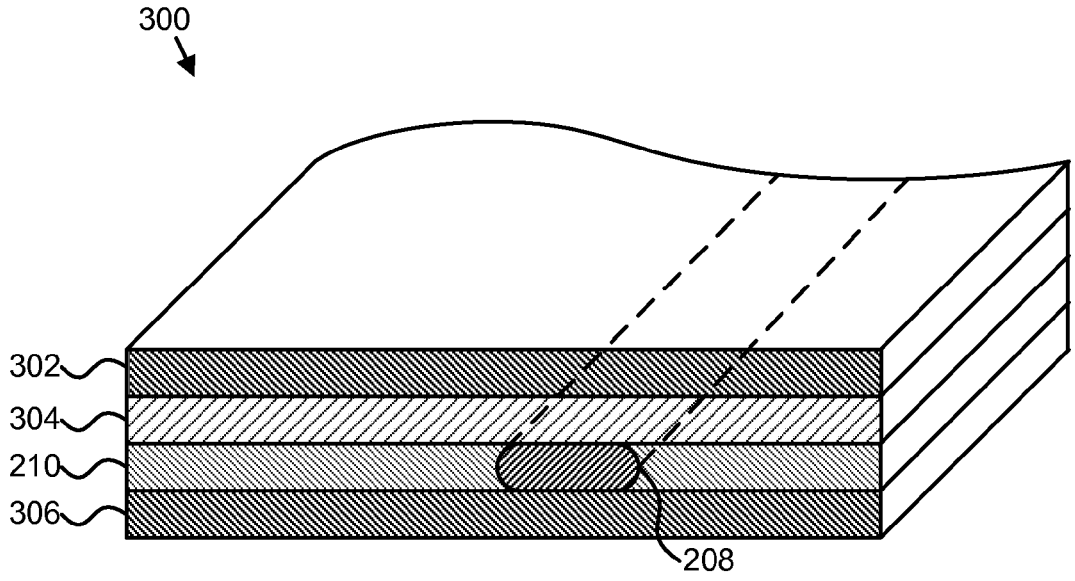
FIG. 3 is a schematic cross-sectional diagram illustrating one embodiment of a modular heated cover.

FIG. 3 illustrates one embodiment of a multilayer modular heated cover 300. In one embodiment, the thermal cover 300 includes a first outer layer 302, an insulation layer 304, a resistive element 208, a heat spreading element 210, and a second outer layer 306. In one embodiment, the layers of the thermal cover 300 comprise fire retardant material. In one embodiment, the materials used in the various layers of the thermal cover 300 are selected for high durability in an outdoor environment, light weight, fire retardant, sun and water rot resistant characteristics, water resistant characteristics, pliability, and the like. For example, the thermal cover 300 may comprise material suitable for one man to fold, carry, and spread the thermal cover 300 in a wet, rugged, and cold environment. Therefore, the material is preferably lightweight, durable, water resistant, fire retardant, and the like. Additionally, the material may be selected based on cost effectiveness.

In one embodiment, the first outer layer 302 may be positioned on the top of the thermal cover 300 and the second outer layer 306 may be positioned on the bottom of the thermal cover 300. In certain embodiments, the first outer layer 302 and the second outer layer 306 may comprise the same or similar material. Alternatively, the first outer layer 302 and the second outer layer 306 may comprise different materials, each material possessing properties beneficial to the specified surface environment.

For example, the first outer layer 302 may comprise a material that is resistant to sun rot such as such as polyester, plastic, and the like. The bottom layer 306 may comprise material that is resistant to mildew, mold, and water rot such as nylon. The outer layers 302, 306 may comprise a highly durable material. The material may be textile or sheet, and natural or synthetic. For example, the outer layers 302, 306 may comprise a nylon textile. Additionally, the outer layers 302, 306 may be coated with a water resistant or waterproofing coating. For example, a polyurethane coating may be applied to the outer surfaces of the outer layers 302, 310. Additionally, the top and bottom outer layers 302, 306 may be colored, or coated with a colored coating such as paint. In one embodiment, the color may be selected based on heat reflective or heat absorptive properties. For example, the top layer 302 may be colored black for maximum solar heat absorption. The bottom layer 302 may be colored grey for a high heat transfer rate or to maximize heat retention beneath the cover.

In one embodiment, the insulation layer 304 provides thermal insulation to retain heat generated by the resistive element 208 beneath the thermal cover 300. In one embodiment, the insulation layer 304 is a sheet of polystyrene. Alternatively, the insulation layer may include cotton batting, Gore-Tex®, fiberglass, or other insulation material. In certain embodiments, the insulation layer 304 may allow a portion of the heat generated by the resistive element 208 to escape the top of the thermal cover 300 to prevent ice and snow accumulation on top of the thermal cover 300. For example, the insulation layer 304 may include a plurality of vents to transfer heat to the top layer 302. In certain embodiments, the thermal insulation layer 304 may be integrated with either the first outer layer 302 or the second outer layer 306. For example, the first outer layer 302 may comprise an insulation fill or batting positioned between two films of nylon.

In one embodiment, the heat spreading element 210 is placed in direct contact with the resistive element 208. The heat spreading element 210 may conduct heat away from the resistive element 208 and spread the heat for a more even distribution of heat. The heat spreading element 210 may comprise any heat conductive material. For example, the heat spreading element 210 may comprise metal foil, wire mesh, and the like. In one embodiment, the resistive element 208 may be wrapped in metal foil. The resistive element 208 may be made from metal such as copper or other heat conductive material such as graphite. Alternatively, the conductive layer may comprise a heat conducting liquid such as water, oil, grease or the like.

Figure 4:
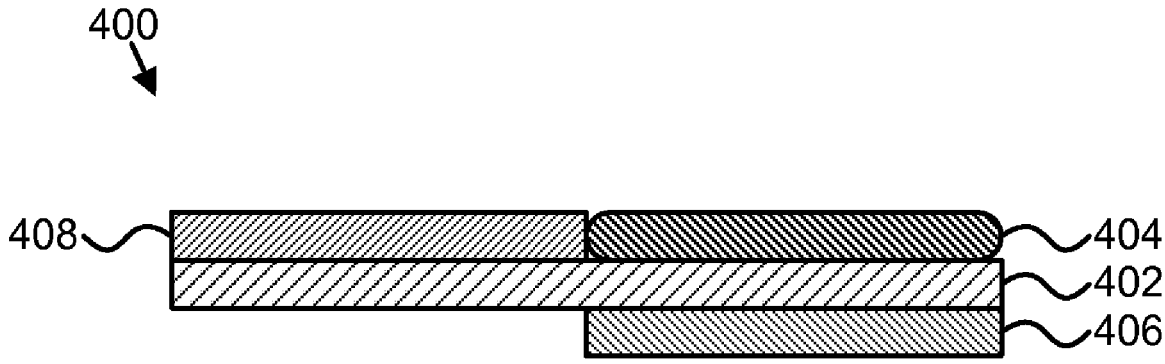
FIG. 4 is a schematic cross-sectional diagram illustrating one embodiment of an air isolation flap.

FIG. 4 illustrates a cross-sectional diagram of one embodiment of an air isolation flap 400. In one embodiment, the air isolation flap 400 includes a portion of a covering sheet 402, a weight 404, a bottom connecting means 406, and a top connecting means 408. In one embodiment, the air isolation flap 400 may extend six inches from the edges of the thermal covering 300. In one embodiment, the air isolation flap 400 may additionally include heavy duty riveted, or tubular edges (not shown) for durability and added air isolation. The covering sheet 402 may comprise a joined portion of the first outer cover 302 and second outer cover 306 that extends around the perimeter of the cover 200 and does not include any intervening layers such as heat spreading layer 210 or insulation layer 304.

In one embodiment, the weight 404 is lead, sand, or other weighted material integrated into the air isolation flap 400. Alternatively, the weight may be rock, dirt, or other heavy material placed on the air isolation flap 400 by a user of the thermal cover 200.

In one embodiment, the bottom connecting means 406 and the top connecting means 408 may substantially provide air and water isolation. In one embodiment, the top and bottom connecting means 408, 406 may include weather stripping, adhesive fabric, Velcro, or the like.

Figure 5:
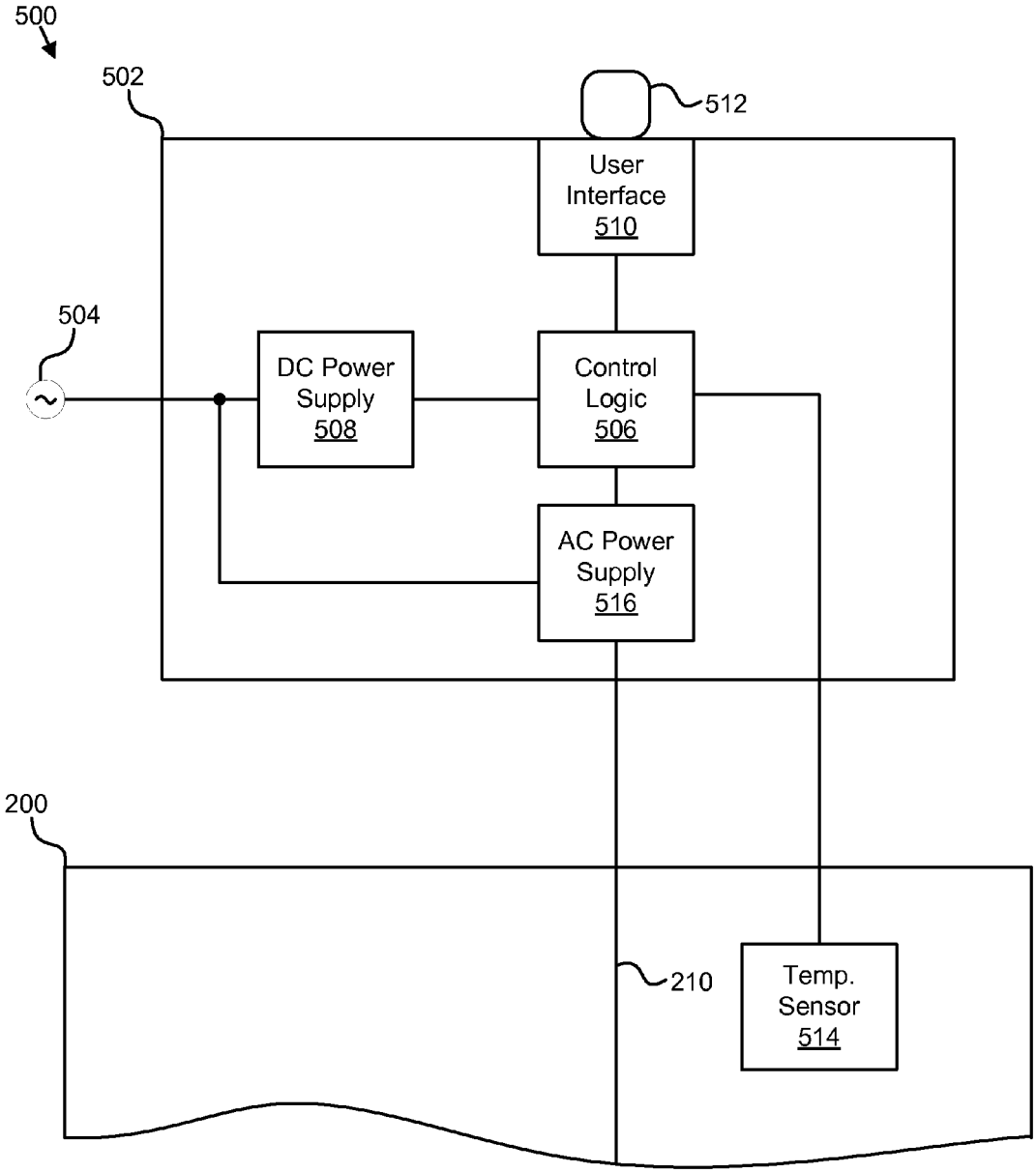
FIG. 5 is a schematic block diagram illustrating one embodiment of a temperature control module.

FIG. 5 illustrates one embodiment of a modular temperature control unit 500. In one embodiment, the temperature control unit may include a housing 502, control logic 506, a DC power supply 508 connected to an AC power source 504, an AC power supply for the thermal cover 200, a user interface 510 with an adjustable user control 512, and a temperature sensor 514.

In one embodiment, the control logic 506 may include a network of amplifiers, transistors, resistors, capacitors, inductors, or the like configured to automatically adjust the power output of the AC power supply 516, thereby controlling the heat energy output of the resistive element 208. In another embodiment, the control logic 206 may include an integrated circuit (IC) chip package specifically for feedback control of temperature. In various embodiments, the control logic 506 may require a 3V–25V DC power supply 508 for operation of the control logic components.

In one embodiment, the user interface 510 comprises an adjustable potentiometer. Additionally, the user interface 510 may comprise an adjustable user control 512 to allow a user to manually adjust the desired power output. In certain embodiments, the user control may include a dial or knob. Additionally, the user control 512 may be labeled to provide the user with power level or temperature level information.

In one embodiment, the temperature sensor 514 is integrated in the thermal cover 200 to provide variable feedback signals determined by the temperature of the thermal cover 200. For example, in one embodiment, the control logic 506 may include calibration logic to calibrate the signal level from the temperature sensor 514 with a usable feedback voltage.

Figure 6:
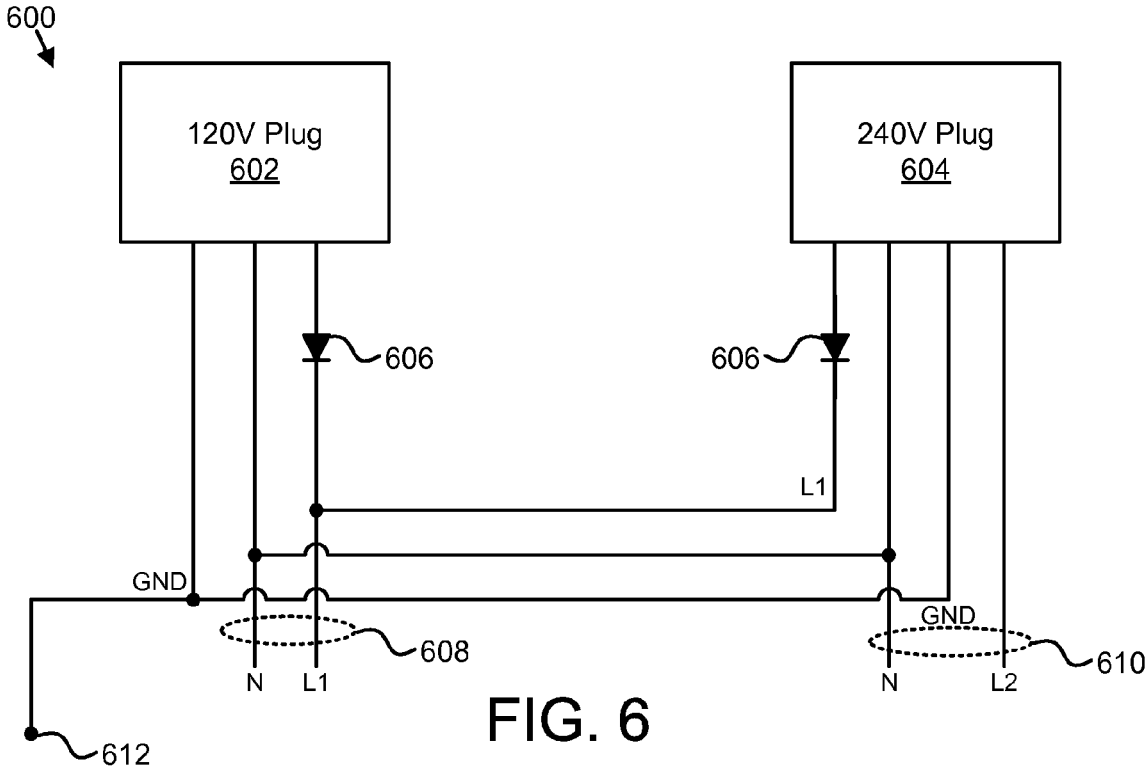
FIG. 6 is a schematic block diagram illustrating one embodiment of an apparatus for providing versatile power connectivity and thermal output.

FIG. 6 illustrates one embodiment of an apparatus 600 for providing versatile power connectivity and thermal output. In one embodiment, the apparatus 600 includes a first electrical plug 602 configured for 120V power, a second electrical plug 604 configured for 240V power, a directional power diode 606, a first active electrical heating element 608, and a second active electrical heating element 610.

In one embodiment, the first electrical heating element 608 is powered when the 120V plug 602 is connected, but the second electrical heating element 610 is isolated by the directional power diode 606. In an additional embodiment, the first electrical heating element 608, and the second electrical heating element 610 are powered simultaneously. In this embodiment, the first electrical heating element 608 and the second electrical heating element 610 are coupled by the directional power diode 606.

In one embodiment, the directional power diode 606 is specified to operate at 240V and up to 70 A. The directional power diode 606 allows electric current to flow from the 240V line to the first electrical heating element 608, but stops electric current flow in the reverse direction. In another embodiment, the directional power diode 606 may be replaced by a power transistor configured to switch on when current flows from the 240V line and switch off when current flows from the 120V line.

In one embodiment, the safety ground lines from the 120V connector 602 and the 240V connector 604 are connected to thermal cover 200 at connection point 612. In one embodiment, the safety ground 612 is connected to the heat spreading element 210. Alternatively, the safety ground 612 is connected to the outer layers 302, 310. In another alternative embodiment, the safety ground 612 may be connected to each layer of the thermal cover 200.

Beneficially, the apparatus 600 provides high versatility for power connections, provides variable heat intensity levels, and the like. For example, the first active electrical heating element 608 and the second active electrical heating element 610 may be configured within the thermal cover 200 at a spacing of four inches. In one embodiment, the first active electrical heating element 608 and the second active electrical heating element 610 connect to a hot and a neutral power line. The electrical heating elements may be positioned within the thermal cover 200 in a serpentine configuration, an interlocking finger configuration, a coil configuration, or the like. When the 120V plug 602 is connected, only the first active electrical heating element 608 is powered. When the 240V plug 604 is connected, both the first active electrical heating element 608 and the second active electrical heating element 610 are powered. Therefore, the resulting effective spacing of the electrical heating elements is only four inches.

The powered lines of both the 120V plug 602 and the 240V plug 604 may be connected to a directional power diode to isolate the power provided from the other plug. Alternatively, a power transistor, mechanical switch, or the like may be used in the place of the directional power diode to provide power isolation to the plugs. In another embodiment, the both the 120V plug 602, and the 240V plug 604 may include waterproof caps (not shown). In one embodiment, the caps (not shown) may include a power terminating device for safety.

Figure 7:
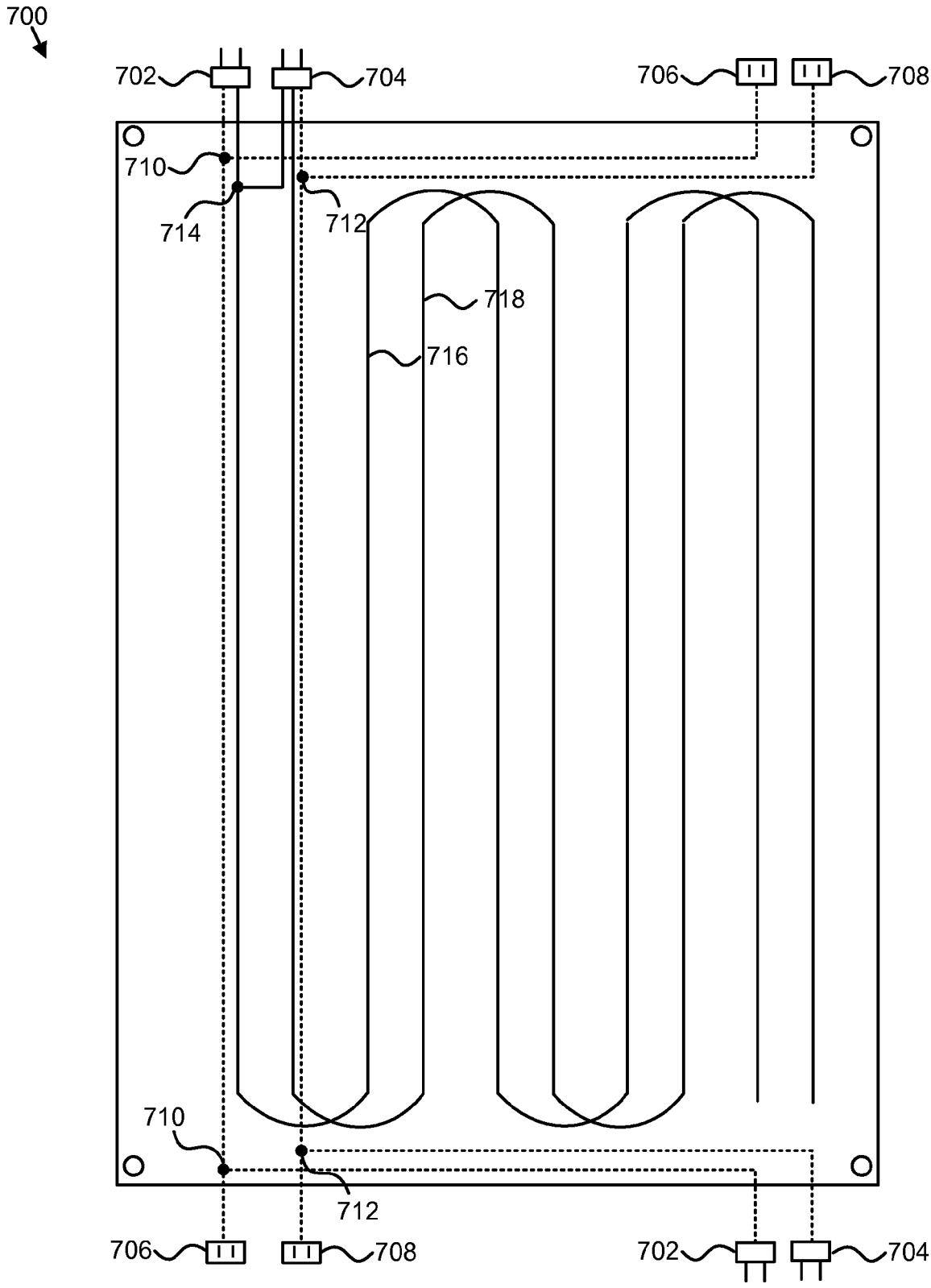
FIG. 7 is a schematic block diagram illustrating one embodiment of a modular heated cover.

FIG. 7 illustrates one embodiment of a modular heated cover 700. In one embodiment, the thermal cover 700 includes one or more 120V plug connectors 702, one or more 240V plug connectors 704, one or more 120V receptacle connectors 706, and one or more 240V receptacle connectors 708. Additionally, the thermal cover 700 may include one or more power bus connections 710 for a 120V power connection, and one or more power bus connections 712 for a 240V power connection.

In one embodiment, the thermal cover 700 may additionally include a power connection 714 between the 120V power line, and one 120V phase of the 240V power line. In certain embodiments, the connection 714 provides power to a first active electrical heating element 716 when the 240V power connector 704 is plugged in. In one embodiment, the 240V power connector 704 may additionally provide power to a second active electrical heating element 718. The 120V power connector 702 may provide power to the first active electrical heating element 716, but not the second active electrical heating element 718. For example, if the 120V power connector 702 is connected to a power source, only the first active electrical heating element 716 is powered. However, if the 240V power connector 704 is connected to a power source, both the first active electrical heating element 716, and the second active electrical heating element 718 are powered. In this example, the first active electrical heating element 716 is powered by the 240V connector through the power connection 714.

Figure 8:
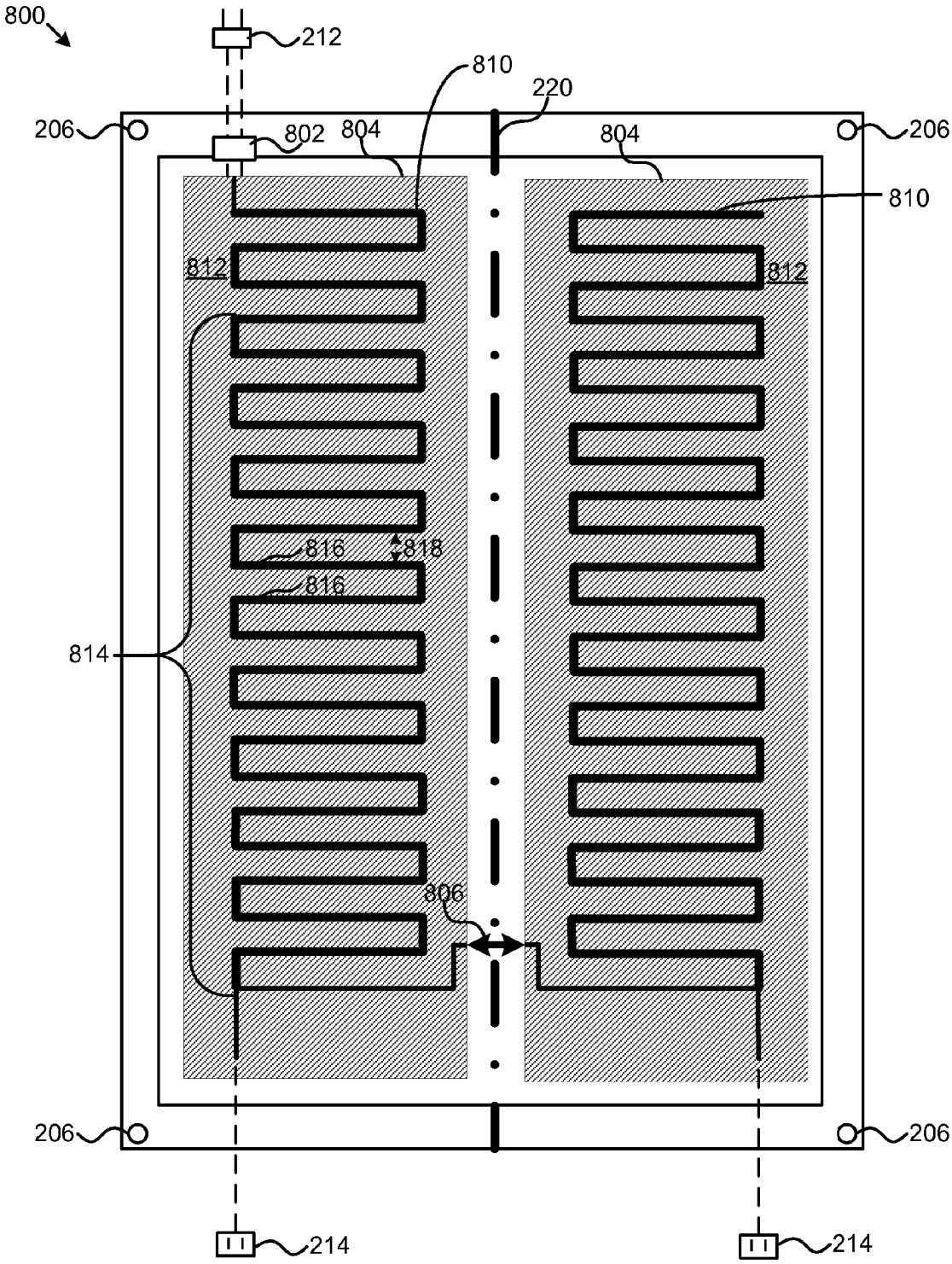
FIG. 8 is a schematic block diagram illustrating one embodiment of a modular heated cover with integrated electrical heating elements.

FIG. 8 illustrates another embodiment of a modular heated cover 800. In one embodiment, the thermal cover 800 includes the multilayered cover 200 comprising a top outer layer 302, a bottom outer layer 306, and an insulation layer 304. However, this alternative embodiment includes one or more integrated thin-film electrical heating elements 804. This embodiment additionally includes an electrical connection 802 for connecting the power plug 212 to the electrical heating element 804. Additionally, an electrical connection 806 may be included to connect multiple electrical heating elements 804 within a single cover 800. Additionally, the cover 800 may include power connectors 212, 214, power connections 216, fasteners 206, folding crease 220, and the like.

In one embodiment, the thin-film electrical heating element 804 may comprise a thin layer of graphite 810, deposited on a structural substrate 812. A protective layer (not shown) may be applied to cover the layer of graphite 810. The protective layer may adhere to, or be heat welded to, the substrate. In one embodiment, the graphite may be deposited on plastic, vinyl, rubber, metal foil, or the like. In one embodiment, the graphite element 804 may be integrated with the insulation layer 304. The graphite may be connected to a contact terminal for providing electric energy to the graphite element.

Preferably, the graphite element 804 converts electric energy to thermal energy in a substantially consistent manner throughout the graphite element. In such an embodiment, a heat spreading element 210 may be omitted from the thermal cover 800 since the graphite 810 serves the purposes of conveying current, producing heat due to resistance, and evenly distributing the heat. Advantageously, the graphite 810, substrate 812, and protective layer are very thin and light weight. In one embodiment, the combination of graphite 810, substrate 812, and protective layer forming the graphite element 804 may be between about 3 and about 20 thousandths of an inch thick. Preferably, the graphite 810 is between about one inch wide and about 10 inches wide and and between about 1 thousandths of an inch thick and about 40 thousandths of an inch thick. In a more preferred embodiment, the graphite 810 is about 9 inches wide and about five thousandths of an inch thick.

In certain embodiments, the graphite 810 may be between 1 thousandths of an inch thick and 40 thousandths of an inch thick. This range is preferred because within this thickness range the graphite 810 remains pliable and durable enough to withstand repeated rolling and unrolling as the cover 800 is unrolled for use and rolled up for storage.

The small size and thickness of the graphite 810 minimizes the weight of the graphite element 804. The graphite element 804 is preferably pliable such that a graphite element 804 can be rolled lengthwise without breaking the electrical path through the graphite 810. Advantageously, the graphite element 804 can be manufactured separately and provided for installation into a cover 800 during manufacturing of the covers 800. For example, the graphite element 804 may come with electrical connections 806 and 802 directly from a supplier such as EGC Enterprises Incorp. of Chardon, Ohio. The graphite elements 804 may be laid on top of an outer cover 302. The electrical connections 802 may be made to power connections 212 and one or more electric power couplings 214. One graphite element 804 may be connected to a second graphite element 804 by an electrical connection 806.

The electrical connection 806 serves as an electrical bridge joining the two graphite elements 804. Preferably, the electrical connection 806 also bridges a crease 220. The crease 220 facilitates folding the cover 800. Preferably, the crease 220 is positioned along the horizontal midpoint.

Finally, the remaining layers of insulation 304 and outer cover 306 are laid over the top of the graphite elements 804 in a manner similar to that illustrated in FIG. 3. Next, the perimeter of the cover 800 may be heat welded for form a water tight envelope for the internal layers. In addition, residual air between the outer layers 302, 306 may be extracted from between the outer layers 302, 306 such that heat produced by the cover 800 is more readily conducted toward the bottom cover 306.

In one embodiment, the graphite 810 is laid out on the substrate according to a predetermined pattern 814. Those of skill in the art will recognize that a variety of patterns 814 may be used. Preferably, the pattern 814 is a zigzag pattern that maintains an electrical path and separates lengths 816 of the graphite 810 by a predefined distance 818. Preferably, the distance 818 is selected such that a maximum amount of the resistance heat produced by a length 816 is conducted away from the length by the substrate, insulation layer 304 and the like. In addition, the distance 818 is selected such that heat conducted from one length does not impede conducting of heat from a parallel length. In addition, the distance 818 is not so large that cool or cold spots are created.

Preferably, the distance 818 is between about ¾ of an inch and about 4 inches wide. Advantageously, this distance range 818 provides for even, consistent heat dissipation across the surface of the cover 800. The smaller the distance 818, the lower the possibility of cold spots in the cover 800. By minimizing cold spots, a consistent and even curing of concrete or thawing of ground can be accomplished.

In a preferred embodiment, the graphite 810 is about 9 inches wide with a minimal distance in between lengths 816 such as about ¾ of an inch. This configuration provides certain advantages beyond minimizing of cold spots. In addition, the larger width of the graphite 810 minimizes the risk that punctures of the graphite 810 will completely interrupt the electrical path. Therefore, accidental punctures can pass through the graphite 810 and the element 804 continues to operate with minimal negative effects.

Advantageously, in certain embodiments, the graphite 810 is used in place of conventional metallic resistive elements 208 such as copper. In embodiments designed to use as much current available on a single 210 Volt circuit protected by up to a 20 Amp breaker, the graphite 810 may be preferred over conventional metallic resistive elements 208 due to the difference in the value of the temperature coefficient of resistance for these materials. Conventional metallic resistive elements 208 typically have a positive temperature coefficient of resistance, while the graphite 801 has a negative temperature coefficient of resistance. The negative temperature coefficient of resistance of graphite 810 reduces power spikes also referred to as "in rush current" drawn when the resistive elements 208 are initially powered.

Of course, the material for the resistive element 208 may be conventional materials such as copper, iron, and the like which have a positive temperature coefficient of resistance. Preferably, the resistive element 208 comprises a material having a negative temperature coefficient of resistance such as graphite, germanium, silicon, and the like. In addition to substantially reducing in rush current, the negative temperature coefficient of resistance elements such as graphite 810 also give off more heat once the current has flowed for some period.

In rush current may be drawn when a cover 800 is initially connected to a power source 100 or when a second cover 800 is coupled to a first cover 800 connected to the power source 100. In embodiments using graphite 810, the in rush current is substantially minimized. Thus, the circuit may be designed to include up to the maximum current draw allowed by the circuit breaker.

In the embodiment illustrated in FIG. 8, the graphite element 804 may efficiently convert energy across a wider surface area than may be available with conventional resistive elements 208. For example, a graphite element configured to draw 6 Amps of current may provide 780 Watts of thermal power evenly across a 23 foot by 12 foot cover surface area. Such a configuration provides sufficient heat energy to maintain a temperature between 50 degrees Fahrenheit, and 90 degrees Fahrenheit, in freezing ambient conditions. Additionally, using such a configuration, it is possible to connect up to three modular thermal covers on a single 120 Volt power source protected by a single 20 Amp circuit. Thus, consistent heat may be provided for between about 300 to about 1000 square feet of surface on a single 20 Amp power source.

In embodiments of the cover 800 that use graphite 810, the negative temperature coefficient of resistance of the graphite 810 will result in the graphite 810 losing resistance as the temperature of the graphite 810 increases. Preferably, the cover 800 is designed such that the two graphite elements 804 do not draw over a maximum current such as about 20 amps. Therefore, the size, width, and length of the graphite 810 are selected such that the combined graphite elements 804 will not draw enough current to activate a 20 amp breaker even when the graphite elements 804 reach the maximum temperature of about ninety-five degrees.

Figure 9:
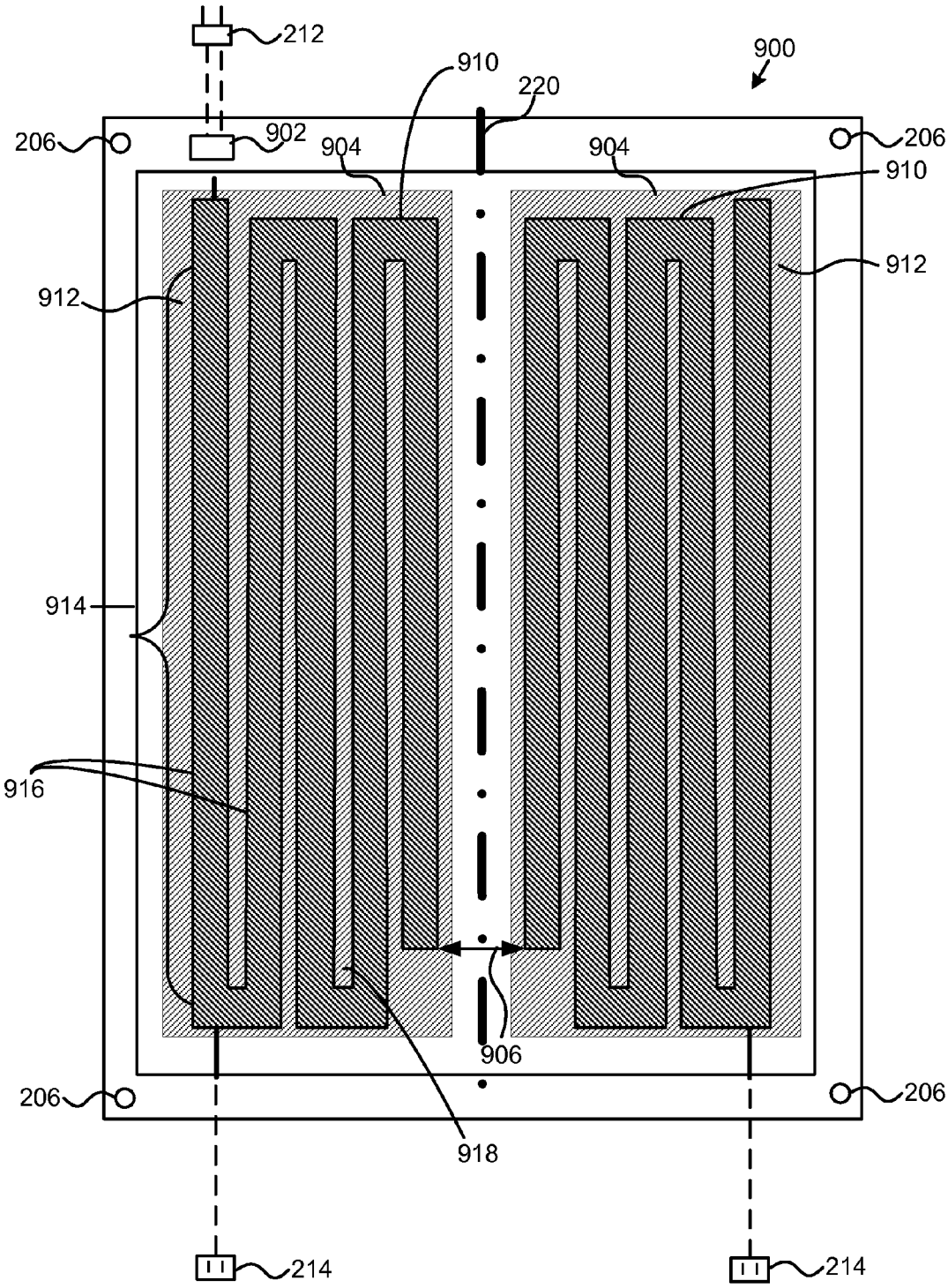
FIG. 9 is a schematic block diagram illustrating another embodiment of a modular heated cover with integrated electrical heating elements.

FIG. 9 illustrates an alternative embodiment of a modular heater cover 900. The cover 900 includes the multilayered cover 200 comprising a top outer layer 302, a bottom outer layer 306, and an insulation layer 304. However, this alternative embodiment includes one or more integrated thin-film electrical heating elements 904. This embodiment additionally includes an electrical connection 902 for connecting the power plug 212 to the electrical heating element 904. Additionally, an electrical connection 906 may be included to connect multiple electrical heating elements 904 within a single cover 800. Additionally, the cover 900 may include power connectors 212, 214, power connections 216, fasteners 206, folding crease 220, and the like.

In FIG. 9, the thin-film electrical heating elements 904 may be similar to those in the cover 800 described above in relation to FIG. 8. The components of the cover 900 with 900 level numbers may be similar to 800 level components of the cover 800 in FIG. 8. However, these heating elements 904 may include a different pattern 914. In addition, the thickness, size, length, and orientation of the graphite 910 may also be different. In the embodiment of FIG. 9, the graphite 910 may be about 9 inches wide, 5 thousandths of an inch thick, with a separating distance 918 of about ¾ of an inch. In certain embodiments, the graphite 910 may be between 1 thousandths of an inch thick and 40 thousandths of an inch thick. This range is preferred because within this thickness range the graphite 910 remains pliable and durable enough to withstand repeated rolling and unrolling as the cover 900 is unrolled for use and rolled up for storage.

In the embodiment of FIG. 9, the pattern 914 may result in graphite lengths 916 that run vertically. Advantageously, vertical lengths 916 that run parallel to each other add to the structural rigidity of the cover 900. Consequently, the cover 900 is less susceptible to being blown back on itself due to wind. As a result a consistent and even heating of the area under the cover 900 is provided.

In an embodiment such as that illustrated in FIG. 9, the graphite 910 may be about 9 inches wide and 5 thousandths of an inch thick with a separating distance 818 for lengths 816 of about ¾ of an inch. Consequently, the resistance for the whole cover 900 may come to about 19 ohms. The cover 900 is designed to connect to a 120 volt circuit. With a drop in resistance of about 0.5 ohms as the graphite elements 904 heat up, the resulting current draw gradually moves from about 6.3 Amps (120 volts/19 ohms=6.3 Amps when first connected to the power source) to about 6.5 Amps (120 volts/18.5 ohms=6.5 Amps when maximum temperature is reached).

As indicated in the background above, the modular heated cover 200 may provide a solution to the problem of accumulated snow, ice, and frost or frozen work surfaces in various construction, residential, industrial, manufacturing, maintenance, agriculture, and service fields.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A modular heated cover comprising:

a first pliable outer layer configured for durable protection in an outdoor environment;

a second pliable outer layer configured for durable protection in an outdoor environment;

a pliable electrical heating element configured to convert electrical energy to heat energy comprising, a resistive element for converting electrical current to heat energy and a substantially planar heat spreading element comprising graphite, the heat spreading element configured to distribute the heat energy generated by the resistive element more readily within a plane of the heat spreading element than out of the plane of the heat spreading element; the pliable electrical heating element disposed between the first and the second outer layers such that the pliable electrical heating element evenly distributes heat over a surface area defined by the first and the second outer layers and an electrical insulation layer disposed between the resistive element and the heat spreading element;

a thermal insulation layer positioned above the pliable electrical heating element and between the first and the second outer layers such that heat from the pliable electrical heating element conducts away from the thermal insulation layer;

a receiving power coupling electrically connected to the electrical heating element, the receiving power coupling configured to couple to a power source; and wherein the first and second outer layers are configured to cooperate to retain air beneath the modular heated cover.

2. The modular heated cover of claim 1, further comprising an electric power coupling connected to the pliable electrical heating element and configured to optionally couple a first modular heated cover to a second modular heated cover such that the first modular heated cover and second modular heated cover draw electricity from a circuit providing up to about 120 Volts and protected by up to about a 20 Amp breaker.

3. The modular heated cover of claim 1, wherein the pliable electrical heating element comprises a resistive element for converting electric current to heat energy, the resistive element disposed between a protective layer and a substrate, according to a pattern configured to evenly distribute heat from the resistive element throughout the substrate, the pattern comprising parallel lengths separated by a distance between ¾ about of an inches and about 4 inches.

4. The modular heated cover of claim 1, wherein the pliable electrical heating element is between about one inch wide and about 10 inches wide and between about 1 thousandths of an inch thick and about 40 thousandths of an inch thick.

5. The modular heated cover of claim 1, wherein the surface area of the pliable electrical heating element is between about one square foot and about 253 square feet.

6. The modular heated cover of claim 1, wherein the electrical heating element is configured such that the electrical heating element has a negative temperature coefficient of resistance such that minimal in rush current is drawn in response to connecting the modular heated cover to a power source.

7. The modular heated cover of claim 1, wherein the electrical heating element is configured with a negative temperature coefficient of resistance such that minimal in rush current is drawn in response to connecting a second modular heated cover to a first modular heated cover coupled to a power source.

8. The modular heated cover of claim 1, wherein the electrical heating element comprises material selected from the group consisting of carbon structured as graphite, germanium, and silicon.

9. The modular heated cover of claim 1, wherein the outer layers are sealed together to form a water resistant envelope around the thermal insulation layer and electrical heating element, the envelope including a minimal quantity of air.

10. The modular heated cover of claim 1, wherein the first outer layer is positioned on the top of the heated cover and colored to absorb heat energy, and the second outer layer is positioned on the bottom of the heated cover and colored to retain heat energy beneath the heated cover.

11. The modular heated cover of claim 1, further comprising an air isolation flap configured to retain heated air beneath the heated cover.

12. The modular heated cover of claim 1, further comprising at least one conveying power coupling, electrically connected to the electrical heating element and configured to optionally couple a first modular heated cover to a second modular heated cover.

13. A modular heated cover comprising:

a top layer and a bottom layer wherein the top and bottom layers provide durable protection in an outdoor environment;

a resistive element between the top and the bottom layers for converting electric current to heat energy;

a planar heat spreading element comprising graphite in contact with an electrical insulation layer that is in contact with the resistive element for distributing the heat energy generated by the resistive element, the planar heat spreading element configured to conduct heat more readily within a plane of the heat spreading element than out of the plane of the heat spreading element;

an air isolation flap configured to prevent heat loss beneath the modular heated cover due to air circulation; an electrical power connection for obtaining electrical energy from a power source configured to provide up to about 120 Volts on a circuit protected by up to about a 20 Amp breaker, the electrical power connection coupled to the resistive element; and an electric power coupling connection for conveying electrical energy from a first modular heated cover to a second modular heated cover, the electric power coupling connection configured to engage an electrical power connection of the second modular heated cover without tripping the breaker.

14. The modular heated cover of claim 13, further comprising a crease configured to facilitate folding of the thermal cover.

15. The modular heated cover of claim 14, wherein the top and bottom layers comprise rugged material configured to withstand outdoor use.

16. The modular heated cover of claim 15, wherein the resistive element and the heat spreading element are integrated.

17. The modular heated cover of claim 16, wherein the resistive element and the heat spreading element are configured to generate and evenly distribute between about 2 watts per square foot and about 4 watts per square foot and the power source supplies between about 6 Amps to about 10 Amps.

18. The modular heated cover of claim 17, further configured to maintain temperatures between about 50 degrees Fahrenheit and about 90 degrees Fahrenheit beneath the modular heated cover in freezing ambient conditions.

19. The modular heated cover of claim 18, wherein the thermal cover is substantially rectangular, and wherein the heat spreading element substantially covers the rectangular area defined by the thermal cover.

20. A system for heating a surface, the system comprising:

a power source configured to supply an electrical current on a 120 volt electric circuit having a breaker rated up to about 20 Amps;

one or more modular heated covers comprising a first outer layer and a second outer layer wherein the outer layers provide durable protection for inner layers, the inner layers comprising an electrical heating element configured to convert electrical energy to heat energy, a planar heat spreading element comprising graphite in contact with an electrical insulation layer that is in contact with the electrical heating element for distributing the heat energy generated by the electrical heating element, a thermal insulation layer positioned above the active electrical heating element, and wherein the first and second outer layers are configured to cooperate to retain air beneath the modular heated cover;

an electrical power plug for obtaining electrical energy from the power source;

an electric power socket for conveying electrical energy from a first modular heated cover to a second modular heated cover connected to the same 120 volt electric circuit.

21. The system of claim 20, further comprising a plurality of electric power sockets and electric power plugs disposed about the perimeter of the thermal cover for coupling multiple modular thermal covers.

22. The system of claim 20, wherein the modular heated covers further comprise an air isolation flap configured to overlap with an air isolation flap of a second modular heated cover.

23. The system of claim 20, further comprising a temperature controller coupled to the electrical heating element and configured to sense a temperature value and control the power supplied to the electrical heating element in response to the temperature value.

* * * * *